US011345444B2

(12) United States Patent
Mills et al.

(10) Patent No.: US 11,345,444 B2
(45) Date of Patent: May 31, 2022

(54) DUAL FOLDING BOAT TOWER

(71) Applicants: Scott J. Mills, Orlando, FL (US); Richard W. Hord, Orlando, FL (US)

(72) Inventors: Scott J. Mills, Orlando, FL (US); Richard W. Hord, Orlando, FL (US)

( * ) Notice: Subject to any disclaimer, the term of this patent is extended or adjusted under 35 U.S.C. 154(b) by 0 days.

(21) Appl. No.: 16/983,061

(22) Filed: Aug. 3, 2020

(65) Prior Publication Data

US 2022/0033036 A1 Feb. 3, 2022

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 6,854,413 | B2 | 2/2005 | Jackson et al. | |
| 9,038,875 | B2 * | 5/2015 | Jesewitz | B63B 32/83 114/343 |
| 9,434,451 | B1 * | 9/2016 | Ostmeyer | B63B 17/02 |
| 10,272,974 | B2 | 4/2019 | Hord et al. | |

* cited by examiner

*Primary Examiner* — Lars A Olson
(74) *Attorney, Agent, or Firm* — Terry M. Sanks, Esq.; Beusse Sanks, PLLC

(57) ABSTRACT

This invention relates to a dual folding boat tower and especially to a boat tower and boat tower top assembly for folding the boat tower and tower top from a storage or down position to an erect or running position.

9 Claims, 6 Drawing Sheets

DUAL FOLDING BOAT TOWER

FIELD OF THE INVENTION

This invention relates to a dual folding boat tower and especially to a boat tower and top assembly for folding the boat tower and top from a storage or down position to an up or running position.

BACKGROUND OF THE INVENTION

Water sports have gained great popularity including water skiing and wake boarding in which a power boat pulls the skier behind the boat using a tow rope. The tow rope is attached to the boat and has a handle at the other end thereof for the skier to hold onto. These ski boats often have a tower extending above the boat for the tow rope. Tow rope towers are frequently fixed rigidly to the boat but it is desirable to be able to fold the towers for storage when they are not in use.

Boats commonly have a T-top, hard top or soft top covering a portion of the hull and it is desirable to be able to fold these tops at times such as when storing the boat.

Hinged folding ski towers on boats in the past have tended to have hinges that allow the towers to wobble or shift position at the hinges when the tower is raised to an upright position of the hinge. It is also difficult to lock and unlock the hinge when raising or lowering the tower. This problem was addressed in our prior U.S. Patent (U.S. Pat. No. 10,272,974) for an improved boat tower hinge which supports a boat tower for use in supporting tow lines used for towing skiers or the like. The hinge can support a boat tower in a raised position while allowing the tower to be swung to a lowered rest position. In the raised tower position the hinge wedges an elongated tongue with polymer sides into an elongated groove having polymer locking inserts to reduce the side-to-side motion of the tower.

The Hord et al. U.S. Pat. No. 10,272,974 shows a folding boat tower having a novel hinge and with a locking position for holding the tower in a running position with greater stability. The Jackson et al. U.S. Pat. No. 6,854,413 is for a more typically folding boat tower.

SUMMARY OF THE INVENTION

This invention relates to a boat or ski tower for boats and especially to a dual folding boat tower which uses the dual pair of hinge assemblies for raising a boat tower from a storage to an upright position. Such boat towers are used for supporting tow lines used for towing skiers or in the raising and lowering of boat tops. The boat tower is rotated between an operative erect tower position and can be lowered for storage or the like when not in use.

A dual folding boat tower mounts to a boat's gunwales to raise the top from a folded position to an operative position. A pair of gunwale brackets attach to the gunwales of a boat and have upwardly extending arms hingedly attached to each of the gunwale brackets. Each arm has an upper and lower portion. An actuator is located in the lower portion and is operatively connected to one of the gunwale brackets for driving the upwardly extending arm from a lower folded position to a generally upright position. A top is hingedly attached to each upwardly extending arm upper portion. Each arm upper portion has an actuator located therein operatively connected to the top for rotating the top from a folded position to an operative running position when said upwardly extending arm is going from a lower folded position to a generally upright position.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

This invention relates to a dual folding boat tower and especially to a boat tower and top assembly for folding the boat tower and top from a storage or down position to an up and running position and back to the storage position.

Figure 1:
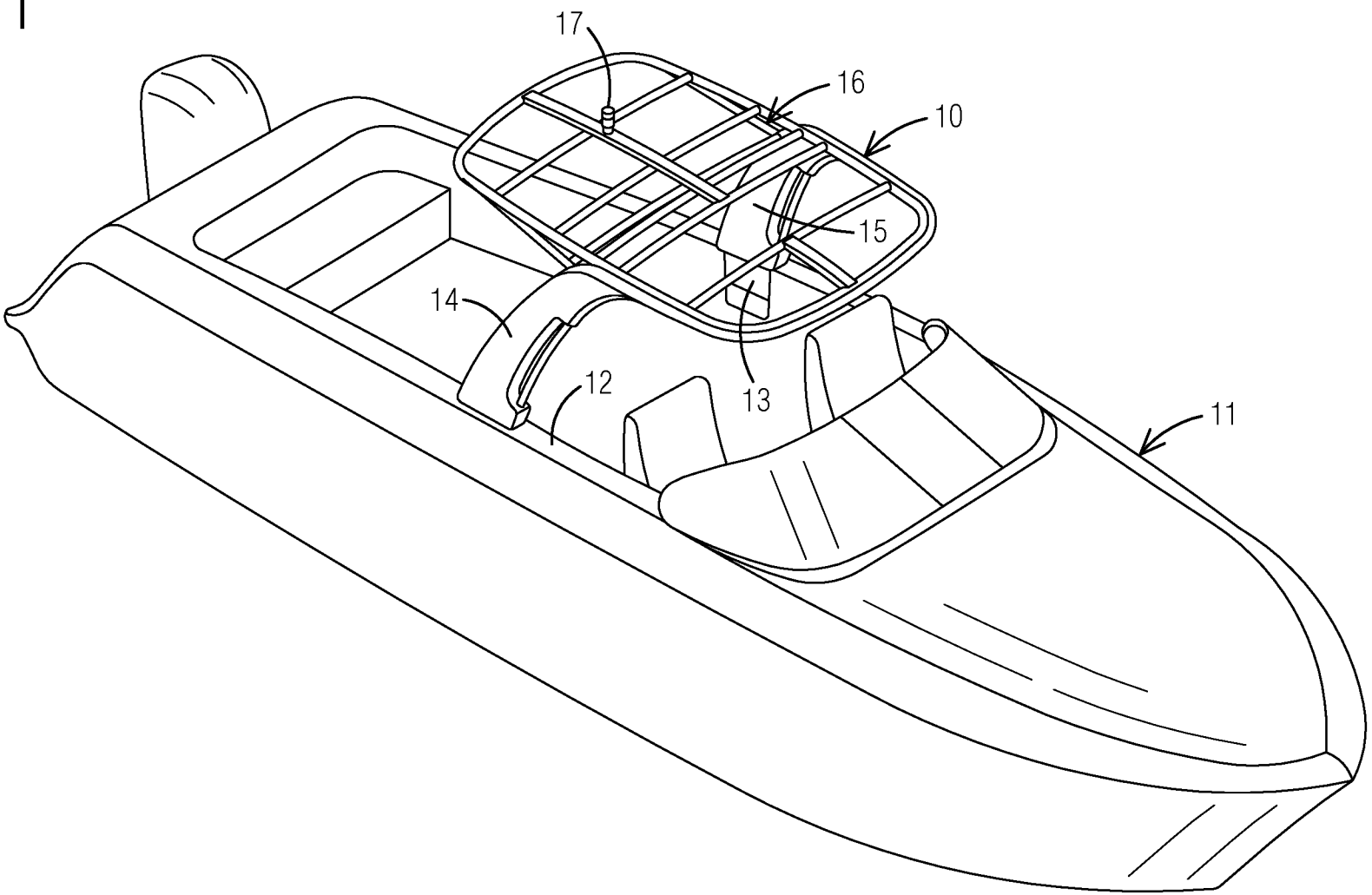
FIG. 1 is a perspective view of a a boat tower attached to a boat in accordance with of the present invention.

Referring to the drawings, FIGS. 1 through 6, and especially to FIG. 1 a boat tower 10 is shown attached to a boat 11 gunwales 12 with gunwale brackets 13. The tower 10 has a pair of upright tower arms 14 and 15 and a top 16. The top 16, shown in the raised or running position, may have a tow rope attachment 17 for attaching a ski tow rope or the like. A fixed hardtop or soft top roof 18 may be attached to the top 16.

Figure 2:
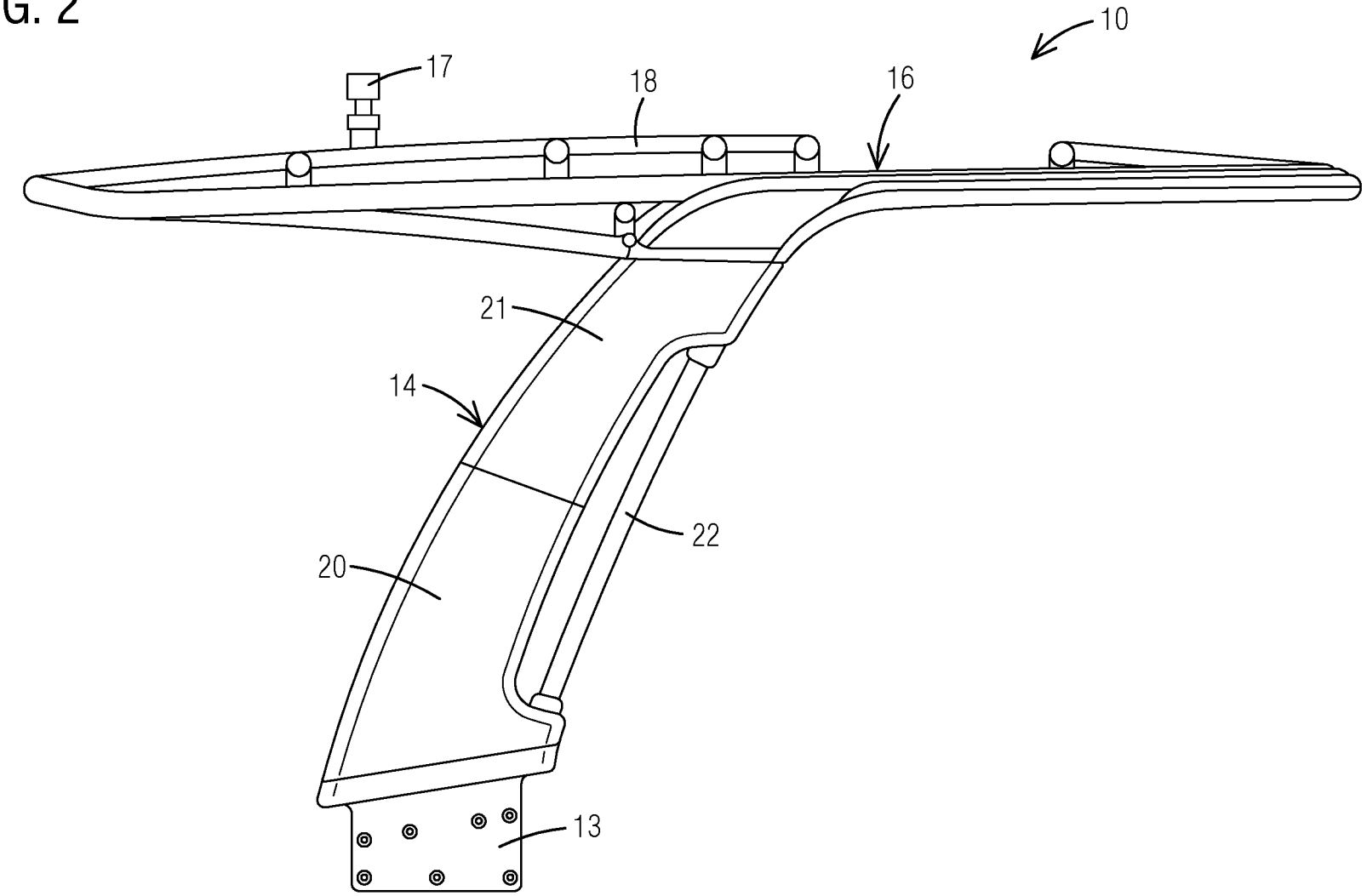
FIG. 2 is a side elevation of the boat tower of FIG. 1 in an up and running position.
Figure 3:
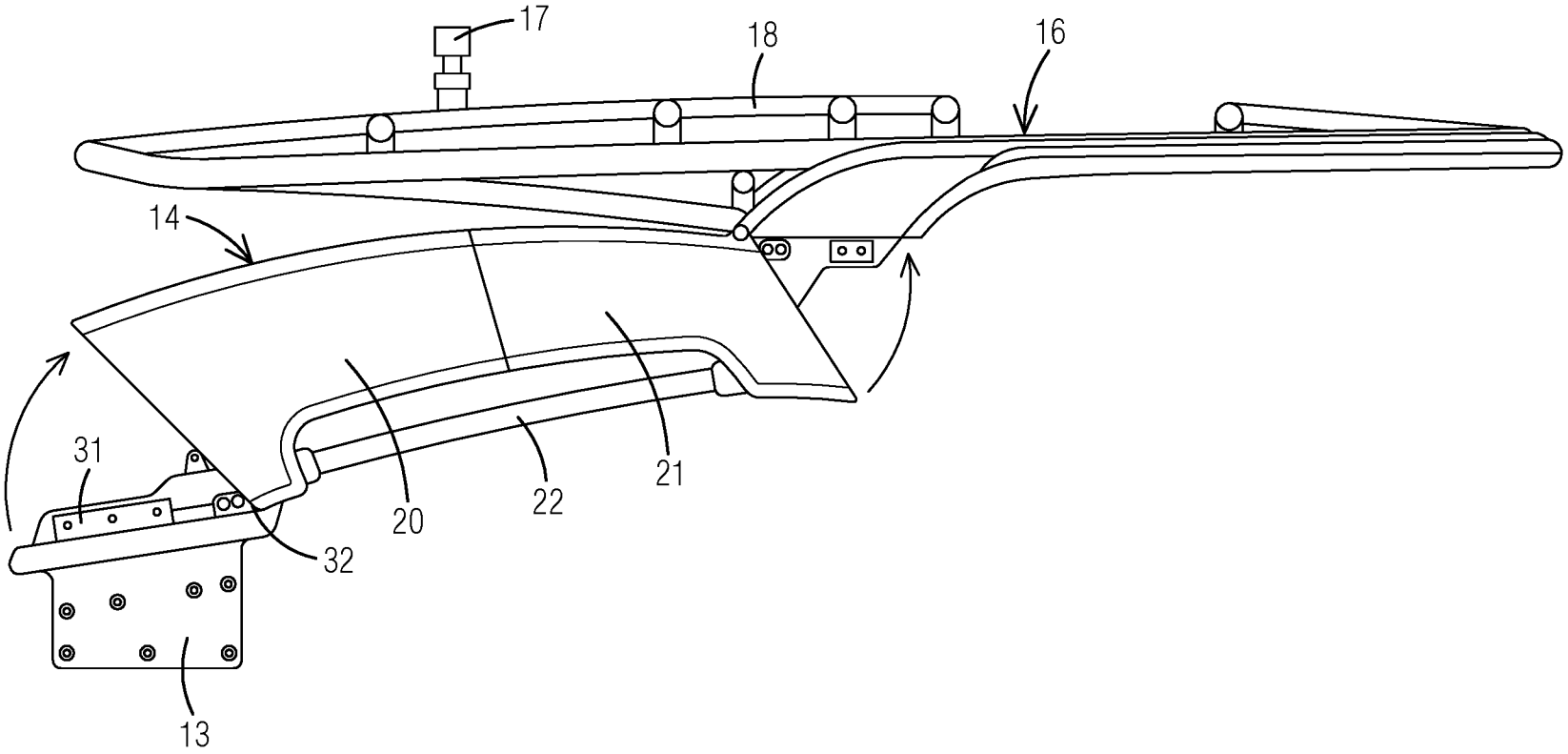
FIG. 3 is a side elevation of the boat tower of FIGS. 1 and 2 in tower down and storage position.

Referring to FIGS. 2 and 3, the boat tower 10 is shown in the upright running position in FIG. 2 and in a folded or storage position in FIG. 3. Each upright tower arm 14 and 15 has a lower portion 20 attached to a gunwale bracket 13 and an upper position 21 attached to the tower top 16. A supporting strut 22 extends between the lower portion 20 and the upper portion 21 of the each upright arm 14. As seen in FIG. 3, the arm 14 lower portion 20 is hinged to the gunwale bracket 13 allowing it to fold on the gunwale bracket 13 as seen in FIG. 3. The top 16 is hinged to the arm's upper portion 21 allowing it to swing into a folded position at the same time as the arm lower position 20 swings on the gunwale bracket 13.

Figure 4:
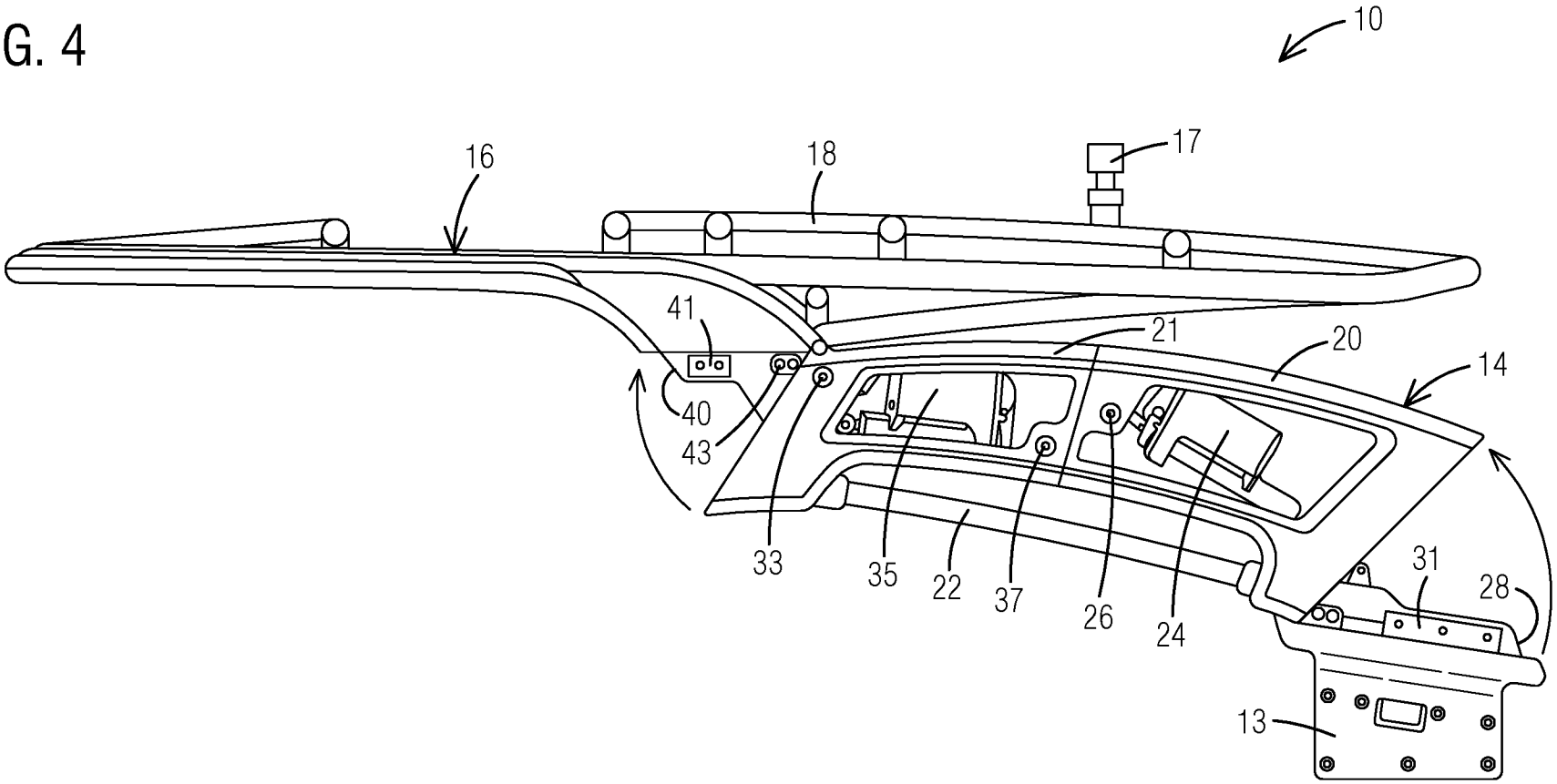
FIG. 4 is a section view of the boat tower of FIGS. 1 to 3 in a folded position showing the operating mechanism.
Figure 5:
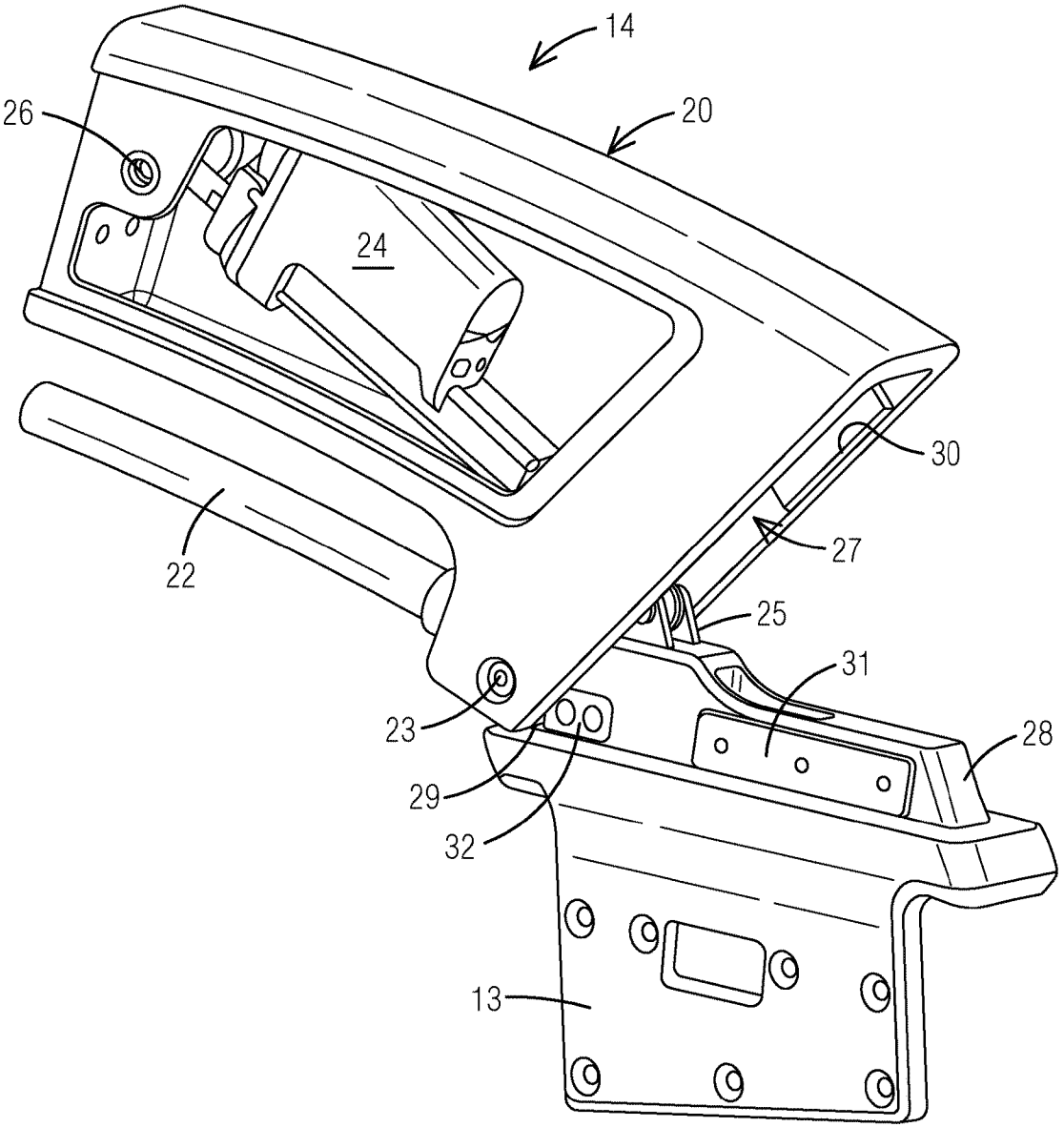
FIG. 5 is a cut-away perspective view of the gunwale bracket with attached upright arm bottom portion.
Figure 6:
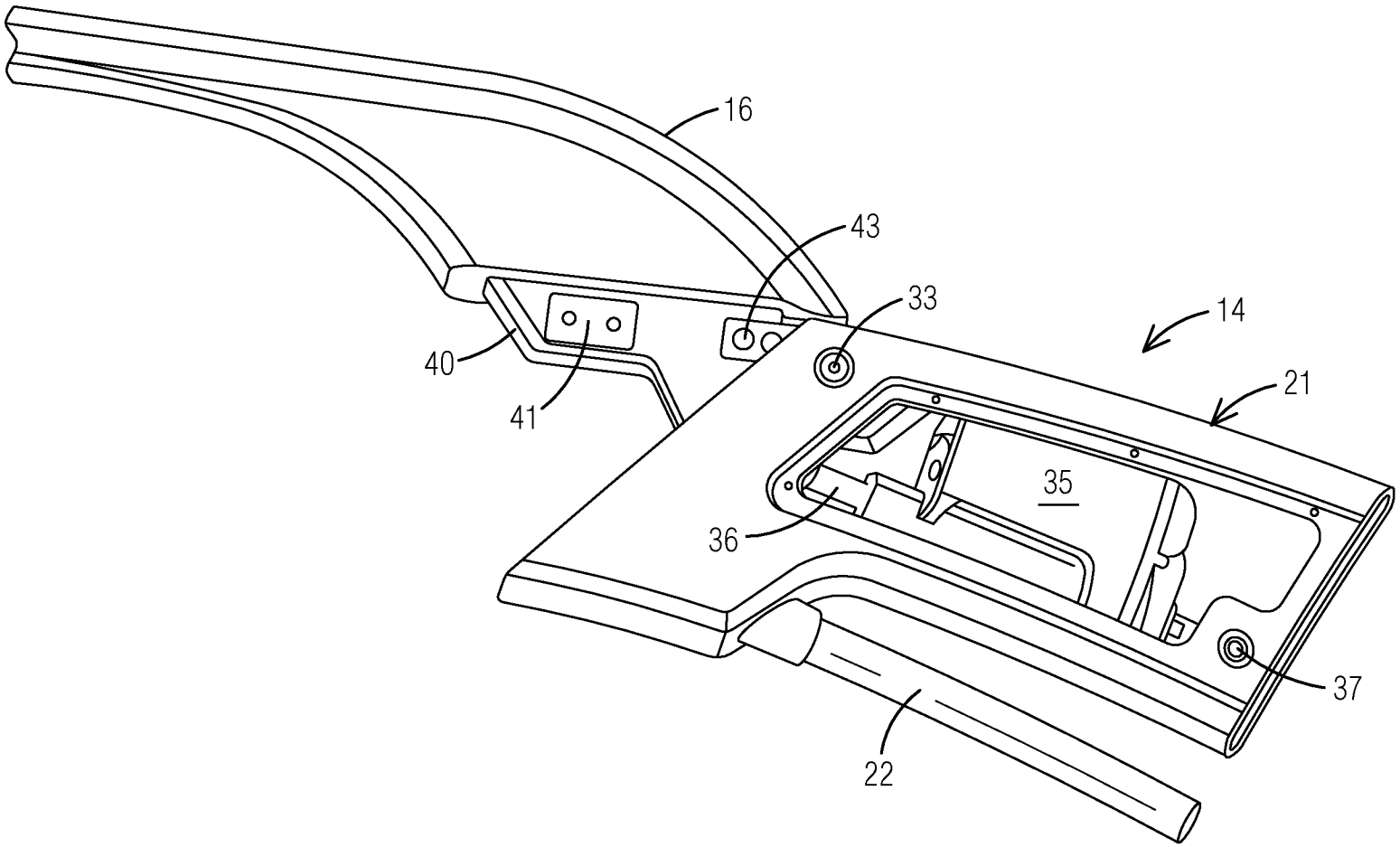
FIG. 6 is a cut-away perspective upright arm top portion with attached top.

Referring more specifically to FIGS. 4 5 and 6, the operation of the dual folding boat tower 10 goes from a running position to the folded position. Each lower arm portion 20 is hinged to a gunwale bracket on each side of the boat at a pivot point 23 and has an actuator 24 mounted therein. The actuator 24 may be an electric motor driving a screw shaft which drives a rod to move the arm 14 from a folded position to an upright position and back. The actuator 24 rod is connected to the actuator attachment 25 on the gunwale bracket 13. The actuator 24 is attached to the arm lower portion 20 with a bolt 26. The lower arm 20 can be seen in FIG. 5 as having a groove 27 in the bottom thereof shaped to fit over a tongue 28. The groove 27 has a pair of polymer tapered wedge inserts 30 mounted therein while the tongue 28 has a pair of elongated polymer members 31 attached thereto. When the arm 14 is in a raised position, the groove 27 wedges on the tongue 28 with the tapered wedge inserts engaging the tongue polymer member to form a positive lock between the arm 14 and the gunwale bracket 13. The gunwale bracket 13 can also be seen as having a locking member 32 which forms a positive stop to limit rotation when lowering the arm 14 to a folded position. As seen in FIG. 5, a locking member 32 abuts against a stop 29 on the lower arm portion 20 of the arm 14 to limit the rotation of the arm in a folded position.

FIG. 6 shows the connection between the top 16 and the arm 14 upper portion 21. The tower top 16 is hinged and pivots on a bolt at a pivot point 33. An actuator 35 which may be an electric motor driving a screw shaft which drives a rod 36 to raise or fold the tower top 16 at the same time as the arm 14 is being rotated on the gunwale bracket 13. The actuator is attached to the arm 13 upper portion 21 with a bolt 37. It will be clear that the folding of the top works in the same manner as the folding of the arm 14 lower portion 20. The upper arm 21 has a groove in the end thereof shaped to fit over a tongue 40. The groove has a polymer tapered wedge insert which is similar to insert 30 of FIG. 5 while the tongue 40 has a pair of elongated polymer members 41 similar to 31 of FIG. 5 attached thereto. When the arm 14 is in a raised position the tower top tongue 40 engages the groove in the upper arm 21 with the elongated polymer members 41 engaging the tapered wedge insert in the groove in the upper arm 21 to form a positive lock between the arm 14 and the tower top 16. The tower top 16 can also be seen as having a locking member 43 which forms a positive stop to limit rotation of the tower top when lowering the arm 14 to a folded position. All the positive locks abut against a stop to limit the rotation of the folding members when the arm 14 is in a folded position. All locks work in the same manner. The locking member 32 abuts against a stop 29 in FIG. 5 to limit the folding of the arm.

It should be clear at this time that a dual folding boat tower for supporting a boat tower top or cover, or the like, has been provided. However the present invention is not to be considered limited to the forms shown which are to be considered illustrative rather than restrictive.

We claim:

1. A dual folding boat tower and tower top comprising:

a pair of gunwales brackets for attachment to the gunwales of a boat;

a pair of upwardly extending arms, each arm being hingedly attached to one said gunwale bracket, each said arm having an upper and a lower portion;

a lower arm actuator having an electric motor having an extendable and retractable rod and being located in said lower portion of each said upwardly extending arm and operatively connected to one said gunwale bracket for driving each said upwardly extending arm from a lower storage position to a generally upright position;

a tower top hingedly attached to the each said upwardly extending arm upper portion;

a tower top actuator having an electric motor having an extendable and retractable rod located in each said upwardly extending arm upper portion and operatively connected to said tower top for rotating said tower top from a folded storage position to an operative covering position while said upwardly extending arm is going from a folded storage position to a generally upright position;

whereby a dual folding boat tower and tower top may be moved between a folded storage position and a raised operative positions with an extended tower top.

2. The dual folding boat tower and tower top in accordance with claim 1 in which each said gunwale bracket has a stop member attached thereto positioned to limit the rotation of each said upwardly extending arm when said upwardly extending arm is being moved to a storage position.

3. The dual folding boat tower and tower top in accordance with claim 2 in which said tower top has a stop member attached thereto positioned to limit the rotation of said tower top when said dual folding tower is being moved to a storage position.

4. The dual folding boat tower and tower top in accordance with claim 3 in which each said upwardly extending arm has a strut extending between the upper and lower portions thereof.

5. The dual folding boat tower and tower top in accordance with claim 2 in which each said tower top actuator electric motor has a screw shaft rotated by its electric motor to extend and retract each extendable and retractable rod.

6. The dual folding boat tower and tower top in accordance with claim 5 in which each said gunwale bracket has a groove formed therein shaped to wedge an upwardly extending arm lower portion tongue therein when said upwardly extending arm is in a raised position.

7. The dual folding boat tower and tower top in accordance with claim 6 in which each said upwardly extending arm lower portion tongue has an elongated polymer member attached to each side thereof for wedging into said groove in each said gunwale bracket.

8. The dual folding boat tower and tower top in accordance with claim 2 in which each said upwardly extending arm lower portion electric actuator extendable rod is rotatably attached to a gunwale bracket actuator attachment.

9. A dual folding boat tower and tower top comprising:

a pair of gunwales brackets for attachment to the gunwales of a boat;

a pair of upwardly extending arms, each arm being hingedly attached to one said gunwale bracket, each said arm having an upper and a lower portion;

a lower arm electric motor actuator located in said lower portion of each said upwardly extending arm and attached to said lower portion of each said upwardly extending arm and being operatively connected to one said gunwale bracket for driving each said upwardly extending arm from a lower storage position to a generally upright position;

a tower top hingedly attached to the each said upwardly extending arm upper portion;

a tower top electric motor actuator located in each said upwardly extending arm upper portion attached to said upwardly extending arm upper portion and operatively connected to said tower top for rotating said tower top from a folded storage position to an operative covering position while said upwardly extending arm is going from a folded storage position to a generally upright position;

whereby a dual folding boat tower and tower top may be moved between a folded storage position and a raised operative positions with an extended tower top.

* * * * *